United States Patent [19]

Resch et al.

[11] 4,041,986

[45] Aug. 16, 1977

[54] DEVICE FOR FORMING A SHED IN A WEAVING MACHINE

[75] Inventors: Josef Resch, Rychnov nad Kneznou; Miloslav Kadlec, Tyniste nad Orlici; Stanislav Zahradnik, Roztoky u Jilemnice; Josef Parizek, Tyniste nad Orlici, all of Czechoslovakia

[73] Assignee: Elitex Koncern textilniho strojirenstvi, Liberec, Czechoslovakia

[21] Appl. No.: 706,058

[22] Filed: July 16, 1976

[30] Foreign Application Priority Data

Aug. 25, 1975 Czechoslovakia ..... 5782-75

[51] Int. Cl.[2] ..... D03C 5/02

[52] U.S. Cl. ..... 139/58; 139/81

[58] Field of Search ..... 139/55, 57, 58, 66, 139/79, 81; 74/570, 571 R, 571 M

[56] References Cited

U.S. PATENT DOCUMENTS

| | | | |
|---|---|---|---|
| 2,067,399 | 1/1937 | Hughes | 74/570 |
| 2,561,344 | 7/1951 | Cutler et al. | 74/571 |
| 3,865,147 | 2/1975 | Lev et al. | 139/79 |
| 3,946,766 | 3/1976 | Amigues | 139/79 |

*Primary Examiner*—Henry S. Jaudon

[57] ABSTRACT

An arrangement for forming sheds in a weaving machine having a plurality of operatively mounted heald shafts forming a heald shaft system. A drive shaft is rotatably mounted in the weaving machine and a plurality of eccentrics are non-rotatably mounted on the drive shaft one behind the other. A bearing is mounted on each eccentric; a rim member is mounted on each bearing and a sleeve is mounted on the rim member. One tie rod is pivotally connected to the rim member and another tie rod is threadably connected to the sleeve. The tie rods are connected via suitable linkages to the heald shaft. When the drive shaft rotates the heald shaft is reciprocated by the action of the eccentrics on the bearing and rim member.

3 Claims, 2 Drawing Figures

DEVICE FOR FORMING A SHED IN A WEAVING MACHINE

BACKGROUND OF THE INVENTION

The present invention relates to a device for forming a shed in a weaving machine. The arrangement of the invention includes a system of eccentrics mounted on a drive shaft, one behind the other, below the heald shaft system of the weaving machine.

The known devices of the state of the art for forming sheds in weaving machines, e.g. of the cam type or the type having driving discs with cam grooves, must be manufactured with close tolerances and wear out quite rapidly during the operation of the weaving machine, particularly because their maintenance is neglected due to their limited accessability on the weaving machine. These and other drawbacks increase steadily as the inbalance of the movable masses increases, which further limits efforts aiming to increase the operating speed of the weaving machine.

SUMMARY OF THE INVENTION

The present invention aims at mitigating the aforedescribed disadvantages and to provide a simple device for forming the shed in a weaving machine which permits an increase in the operational speed of the weaving machine. The device of this invention is constructed in such a way that on each eccentric of the driving shaft, below the heald shaft system, there are mounted a rim and a sleeve which are mutually offset by about 180°. The rim is actually mounted on a bearing which is mounted on the eccentric. The rim and sleeve have, on parts of their circumferences, holders for tie rods to which the heald shafts are connected via linkages.

BRIEF DESCRIPTION OF THE DRAWING

The invention is further set forth in the following detailed description taken in conjunction with the appended drawing, in which.

DETAILED DESCRIPTION

Figure 1:
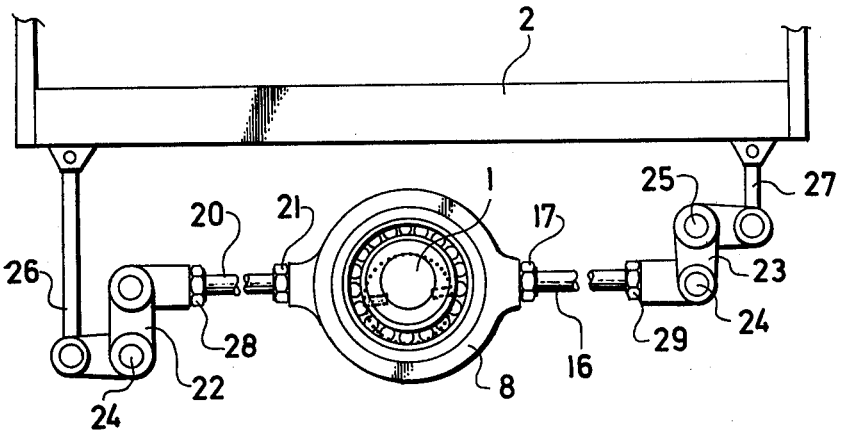
FIG. 1 is a front elevation of the arrangement in accordance with this invention.
Figure 2:
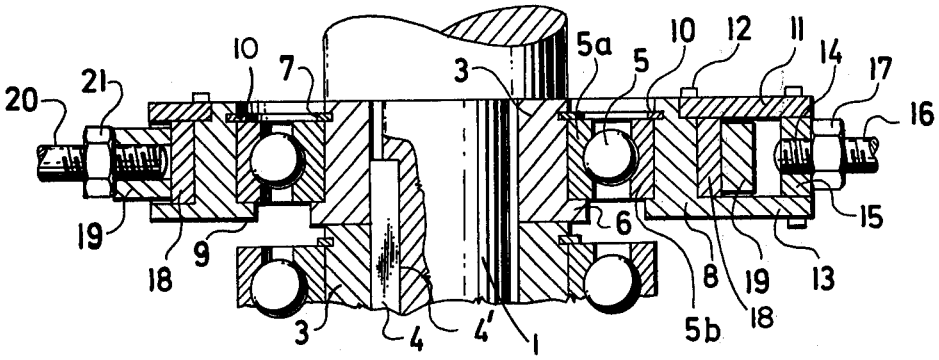
FIG. 2 is a cross-sectional view through the arrangement for forming a shed as shown in FIG. 1, in which certain constructional details are illustrated.

The shed forming device, in accordance with this invention, consists of a drive shaft 1, which is mounted transversely to the heald shaft system 2. A plurality of eccentrics 3 are mounted on the shaft 1 and are mutually offset on said shaft. A key 4 extends into a groove 4' of the shaft 1 thereby securing the eccentric 3 from rotating relative to the shaft 1. The eccentrics 3, the number of which corresponds, for example to the number of control heald shafts 2 in their system are mutually coincident. Each eccentric 3 is provided at its inner periphery with at least two grooves arranged opposite each other by means of which the eccentrics 3 can be angularly adjusted relative to each other up to 180° on the drive shaft 1.

The provision of two grooves in the eccentrics 3 simplifies the manufacture thereof and permits the use of one eccentric unit instead of two.

A roller bearing 5 is mounted on each eccentric 3. The inner race of the roller bearing bears against a circular step 6 on the eccentric 3, and the other side of the inner race **5*a* of the roller bearing 5 is secured against displacement by a safety ring 7. The rim member 8, having a step 9, is mounted on the outer race 5*b* of the roller bearing 5. A second safety ring 10 holds the outer race 5*b* in place. A lid 11 is secured to the rim 8 by means of screws 12. The rim member 8 has, on one side, an integral holding member 13 radially projecting therefrom. The lid 11 for the rim member 8 extends parallelly to the holding member 13 thereof. A holder is therefore composed of the radially outer portions of the lid 11 and the holding member 13. A block 15 has a threaded opening for receiving the threaded end of a tie rod 16 and is pivotally mounted between the lid 11 and the holding member 13 by means of a pin 14. The pin or pins 14 are mounted in mating apertures (not shown) in the lid 11 and member 13. A securing nut 17 is threadably mounted on the rod 16. The cylindrical surface of rim 8 serves for supporting a sleeve 19 which includes support ring 18. The sleeve 19 has a threaded opening for receiving a fastening tie rod 20. A securing nut 21 is threadably mounted on the tie rod 20**.

The tie rods 16 and 20 are journalled to angular levers 22 and 23, which are secured to stationary pins 24 and 25 below the heald shaft system 2. The reciprocating motion of the angular levers 22 and 23 is transmitted to the heald shaft 2 by means of tie rods 26 and 27 which are respectively pivotally connected to the heald shaft 2. The tie rods 16 and 20 are provided, at the end connected to the angular levers 22 and 23, with threaded ends on which the securing nuts 28 and 29 are respectively threadably mounted.

The arrangement for forming sheds, in accordance with this invention, operates as follows:

The rotation of the drive shaft 1 imparts a rotary motion to the eccentrics 3 mounted thereon. These eccentrics 3 are arranged on the shaft 1 at a predetermined angular distance from each other. Upon rotation of the drive shaft 1, the eccentrics 3 are in turn rotated, which imparts a rotating motion to the inner race **5*a* of the roller bearing 5 only. The outer race of 5*b* of the roller bearing 5 together with the rim member 8 perform an oscillating swinging motion in the lateral direction because of the eccentricity of the eccentric 3. On one side of the axis of the shaft 1, the oscillatory lateral motion of the rim member 8 is transferred, by means of the blocks 15 attached thereto, to the appurtenant tie rod 16. On the opposite side of the axis of the shaft 1, the oscillatory lateral motion of the rim member 8 is transferred to the tie rod 20 via the intervening sleeve 19 and associated support ring 18**.

The adjustment of the device for forming sheds can be performed in a simple manner by turning the tie rods 16 and 20 with their threaded ends. Once a desired length has been obtained for the tie rods 16 and 20, they are secured in the new adjusted length by tightening the securing nuts 17, 29 and 21, 28. It is possible when weaving a so-called "plain weave", to control simultaneously more than one heald shaft 2 by means of one eccentric 3. The "plain weave", for example with four heald shafts, can then be performed in such a manner, that the tie rods 16 and 20 from one eccentric 3 are coupled to a pair of angular levers 22 and 23 respectively. The tie rods 16 and 20 from a further eccentric 3 are also mounted in such a manner, that upon weaving the said "plain weave", two heald shafts 2 from the system alternate their motion with the remaining two heald shafts 2 of the system.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a weaving machine having an operatively mounted heald shaft, an arrangement for forming sheds, comprising a drive shaft rotatably mounted in the weaving machine;

an eccentric non-rotatably mounted on said drive shaft;

a bearing mounted in the eccentric;

a rim member coaxially mounted on the bearing;

a sleeve mounted on said rim member; and a pair of linkage means operatively connected to the heald shaft;

one of said pair of linkage means being operatively connected to said rim member and the other being operatively connected to said sleeve; whereby the heald shaft is reciprocated by the drive shaft when the eccentric is rotated by the drive shaft.

2. In a weaving machine, the arrangement for forming sheds as set forth in claim 1, wherein each of said linkage means include a tie rod, one tie rod being pivotally connected to said rim member and the other tie rod being threadably connected to said sleeve.

3. In a weaving machine, the arrangement for forming sheds as set forth in claim 2, wherein the length of said tie rods is adjustable.

* * * * *